US005615941A

United States Patent [19]

Shecter

[11] Patent Number: 5,615,941

[45] Date of Patent: Apr. 1, 1997

[54] ILLUMINATED DUAL LOLLIPOP HOLDER AND STORAGE DEVICE

[76] Inventor: Jules Shecter, 3301 Harrington Dr., Boca Raton, Fla. 33496

[21] Appl. No.: 653,659

[22] Filed: May 20, 1996

[51] Int. Cl.[6] ..... F21V 33/00

[52] U.S. Cl. ..... 362/109; 362/234; 362/253; 362/800; 362/154; 426/112; 426/134

[58] Field of Search ..... 362/109, 119, 362/120, 234, 253, 154, 155, 800, 806; 426/112, 115, 134, 111

[56] References Cited

U.S. PATENT DOCUMENTS

| | | | |
|---|---|---|---|
| D. 161,595 | 1/1951 | Rubin et al. | D82/2 |
| D. 288,140 | 2/1987 | Fontlladosa | D1/106 |
| D. 313,689 | 1/1991 | Epstein | D1/102 |
| D. 320,300 | 10/1991 | Good et al. | D1/104 |
| D. 323,417 | 1/1992 | Cacia | D1/102 |
| D. 346,475 | 5/1994 | Bierend | D1/102 |
| D. 353,031 | 12/1994 | Pope | D1/102 |
| D. 353,064 | 12/1994 | Gilbert | D6/450 |
| 1,567,284 | 12/1925 | Miller . | |
| 2,417,480 | 3/1947 | Friedman | 46/179 |
| 2,617,324 | 11/1952 | Brody | 84/330 |
| 2,739,065 | 3/1956 | Hugin | 99/138 |
| 4,229,482 | 10/1980 | Kreake, Jr. | 426/134 |
| 4,902,519 | 2/1990 | Ream et al. | 426/91 |
| 4,914,748 | 4/1990 | Schlotter, IV et al. | 362/109 |
| 5,066,502 | 11/1991 | Eales | 426/75 |
| 5,209,692 | 5/1993 | Coleman et al. | 426/134 X |
| 5,458,277 | 10/1995 | Wyzykowski | 224/202 |
| 5,471,373 | 11/1995 | Coleman et al. | 362/253 X |
| 5,484,602 | 1/1996 | Stanley et al. | 424/440 |
| 5,503,857 | 4/1996 | Coleman et al. | 426/112 X |

*Primary Examiner*—Stephen F. Husar
*Attorney, Agent, or Firm*—John C. Smith

[57] ABSTRACT

A dual lollipop holder and storage device which has a lollipop compartment at both ends. Lollipop sticks are removably attached to retractable securing attachments which extend the lollipops from opposite ends of the holder. End caps allow the lollipops to be sealed within the lollipop holder when the lollipops are in the retracted position. The retractable securing attachments can optionally be spring loaded to extend the lollipop automatically. An optional integral lighting mechanism illuminates the lollipop holder for the user's amusement. The lighting mechanism can be implemented by conventional battery operated lamps such as LEDs or by electroluminescent (EL) lamps. EL lamps can be used to form a substantial part of the outer shell to maximize the illumination effect.

20 Claims, 8 Drawing Sheets

ILLUMINATED DUAL LOLLIPOP HOLDER AND STORAGE DEVICE

BACKGROUND OF THE INVENTION

1. Technical Field

The present invention relates to novelty items for use with confectionary products. In particular, it relates to illuminable handle assemblies which hold multiple replaceable lollipops that can be retracted into enclosed storage areas.

2. Background Art

Lollipops have been a popular confectionary item for many years. This type of candy is popular for many reasons, including taste, portability, resistance to spoilage, etc. Prior art devices have been invented which provide features that can be used to make consumption of lollipops more enjoyable or to allow lollipops to be used for other purposes.

For example, musical lollipops are known which are constructed in the form of a flute or whistle such that the lollipop itself can produce sounds. Lollipop holders capable of producing sounds are also known. Typically, sound producing lollipops or lollipop holders are designed to provide amusement to the consumer.

Lighting devices and/or light emitting pops are also known. Typically, a light emission device would be integrated into a lollipop holder assembly such that the handle could be turned on to produce light when desired. As was the case with sound producing items, the use of light mechanisms in conjunction with a lollipop is typically done for amusement purposes.

Another use for lollipops has been as an alternative to traditional ingestion techniques for medicine. By ingesting medicine via medicated lollipops, children and disabled adults can be administered does of medicine in a more convenient manner.

As can be seen from the foregoing, a variety of devices and lollipops have been developed suit both entertainment and practical needs. However, while there are many devices related to lollipops, the devices do not address a particular problem which is caused the long period of time it takes to consume a lollipop. In particular, lollipops last a long time and due to this they tend to be consumed incrementally. Between consumption sessions, the user is faced with the problem of what to do with the lollipop which is sticky and tends to adhere to dirt and biological contamination. This is especially troublesome for children who by their nature will be more haphazard than adults when handling lollipops.

Known containers provide a case for holding a lollipop which could be worn around the consumers neck similar to a necklace. Disadvantages to this approach are the inconvenience of carrying the device in this manner. Further, since the lollipop is loose within the outer shell of the device, the inside surface of the shell can become sticky and inconvenient to handle. It would be desirable to have a lollipop holder which overcame the disadvantages of messiness and inconvenient methods of transport common to this device by providing a method of storing a lollipop without getting the consumers fingers sticky and also by providing a method of storage which could be conveniently used in a variety of ways.

Prior lollipop devices use a single pop having a single flavor. If a consumer desired to have more than one flavor, multiple lollipops would have to be carried. Likewise, a parent with more than one child would have to carry multiple lollipops, one for each child, resulting in an inconvenient and messy collection of candy which would have to be discarded or stored between uses.

The prior art has failed to provide a lollipop holder device which provides a clean holder for multiple replaceable lollipops, amusement devices such as illuminable holders, and a convenient storage compartment which is available when consumption of the lollipop is interrupted.

SUMMARY OF THE INVENTION

The present invention solves the foregoing problems by providing a dual lollipop holder which has a lollipop compartment at both ends. Lollipop sticks can be removably attached to retractable securing attachments which extend the lollipops from opposite ends of the holder. End caps allow the lollipops to be sealed within the lollipop holder when the lollipops are in file retracted position. The retractable securing attachments can optionally be spring loaded to extend the lollipop automatically. An integral lighting mechanism illuminates the lollipop holder for the user's amusement. Optionally, the light mechanism can be implemented by conventional battery operated lamps such as LEDs or by electroluminescent (EL) lamps. If EL lamps are used, they can be located internally with side apertures or they can be located externally to form a substantial part of the outer shell to maximize the illumination effect.

DESCRIPTION OF THE PREFERRED EMBODIMENT

Figure 1A:
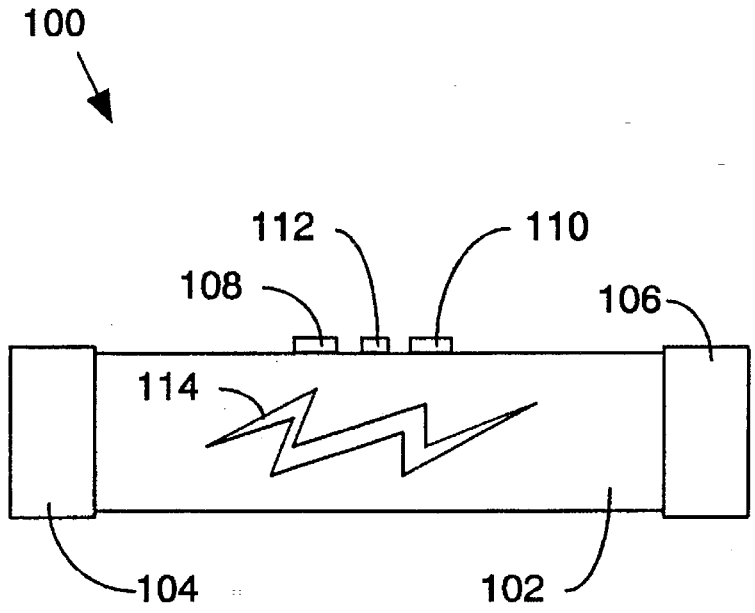
FIG. 1A is a side view of a preferred embodiment which illustrates the end caps and a side aperture for light emission.

Referring to FIG. 1A, this figure shows a side view of dual lollipop holder 100 (hereinafter holder 100). This view shows a central storage compartment 102 with end caps 104, 106 attached to its ends. Since lollipops may not be completely sealed between uses, it is desirable to have a sanitary storage compartment to store the lollipop until the next use. The purpose of end caps 104, 106 is to seal central storage compartment 102 such that the lollipop stored within remains clean. Of course, end caps can be constructed in any manner which allows lollipops to be enclosed within central storage compartment 102 and may even be integrated into holder 100 as a revolving shield or panel, etc.

Also shown in this figure are slide buttons 108, 110, light aperture 114, and lamp switch 112. As will be explained more fully below, slide buttons 108, 110 are used to activate movement of a lollipop from the retracted to the extended position. Lamp switch 112 is used to activate an internal lamp (shown FIGS. 4C and 4D) which is provides amusement value to the consumer. The illumination can be kept on or be automatically switched on and off for effect. Light aperture 114 is shown as a lightning bolt shape for illustrative purposes, but the shape of light aperture 114 can take any convenient form or even spell a message such as school name, team name, business logo, etc. Likewise, light aperture 114 can be an actual aperture or (as in the preferred embodiment) a window which transmits light but is otherwise sealed for sanitary purposes.

Figure 1B:
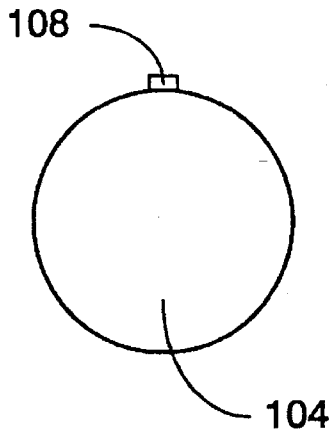
FIG. 1B is an end view of the device of FIG. 1A.

In FIG. 1B, an end view of the embodiment of FIG. 1A is shown. This view shows end cap 104 and slide button 108. Those skilled in the art will recognize that while the cylindrical shape illustrated in the figures is most appropriate for a spherically shaped candy such as that used to make sucker type lollipops, any suitable shape can be used to accommodate a particular type of lollipop. For example, many lollipops are made in a substantially flat "coin shaped" form. This type of lollipop could easily fit into a holder 100 designed with a flat shape to accommodate such a lollipop.

Figure 2:
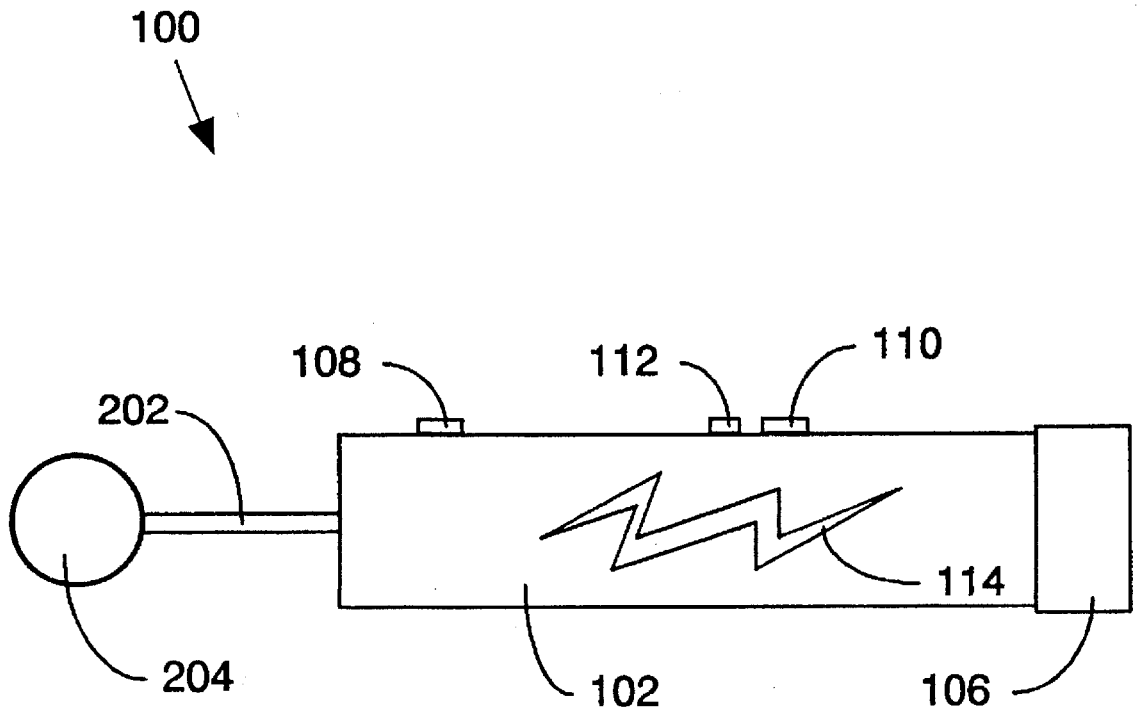
FIG. 2 is a side view of a preferred embodiment showing an end cap removed and a lollipop extended from one end.

FIG. 2 shows the embodiment of FIGS. 1A–B with end cap 104 removed and a lollipop 204 and lollipop stick 202 in the extended position. For ease of illustration, end caps 104, 106 are shown as simple pressure fit caps. However, any suitable method of attachment of the end caps 104, 106 can be used, such as threaded screw-on type caps, BNC type locks, etc. Likewise, attachment straps can also be used to prevent end caps 104, 106 from being detached from holder 100 thereby preventing their accidental loss.

Figure 3:
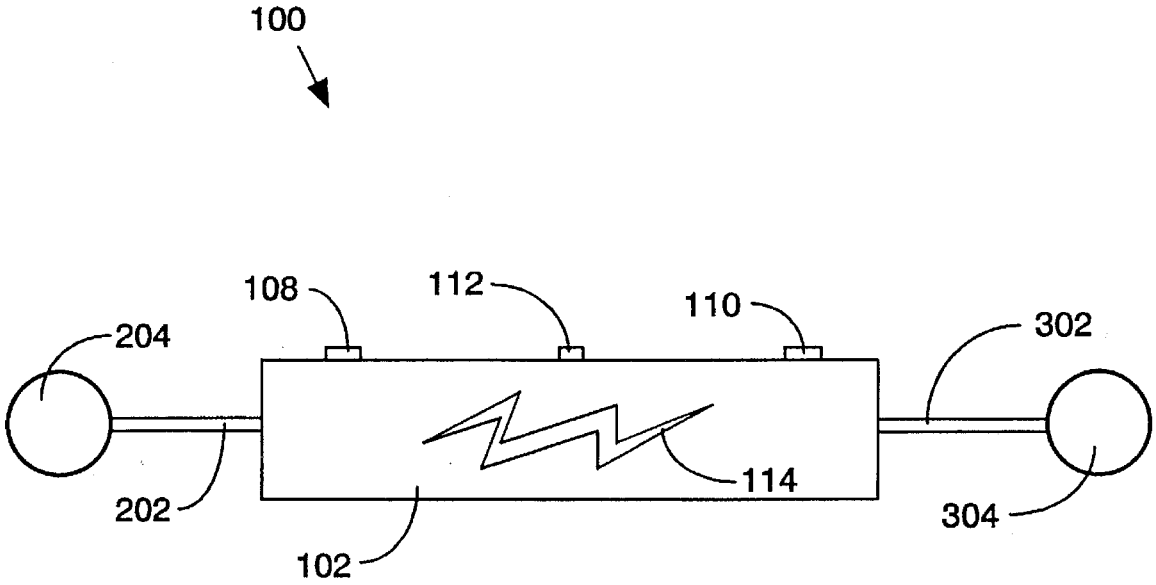
FIG. 3 is a side view of a preferred embodiment showing both end caps removed and both lollipops extended.

FIG. 3 shows the embodiment of FIGS. 1A–B with both end caps 104, 106 removed and lollipops 204, 304 and lollipop sticks 202, 302 in the extended position. Of course, a user would typically use one lollipop 204, 304 or the other, and not both. This figure merely illustrates that two lollipops can be stored in holder 100 at the same time.

An advantage of a dual lollipop storage device such as holder 100 is that more than one flavor can be carried and used at one time. Further, since holder 100 allows one lollipop to be stored while the other is used, a parent with two children can carry a single storage device which holds a lollipop for each child that keeps each lollipop separate for sanitary reasons and allows the children to share the device when desired.

In the preferred embodiment, the holder 100 is made from inexpensive disposable materials such as plastic, cardboard, etc. Of course, a reusable holder 100 could also be fabricated from appropriate materials (i.e., those which can be cleaned between uses). In the case of a reusable holder 100, an access door (not shown) would be required to allow battery replacement.

Figure 4A:
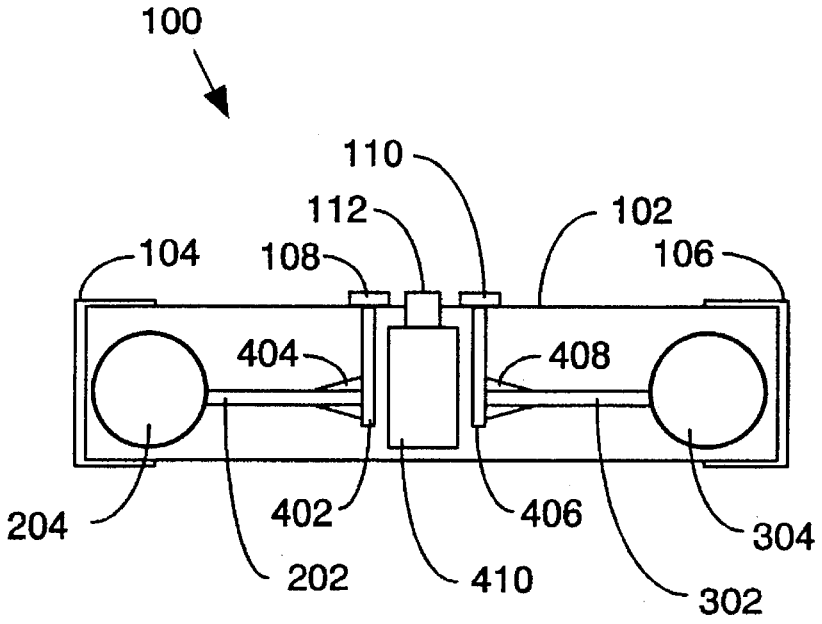
FIG. 4A is a cutaway side view showing two lollipops attached to retractable securing devices in the retracted position. A lamp controller and lamp switch are shown mounted between the retractable securing devices.

FIG. 4A shows a side cutaway view of holder 100. For ease of illustration, illumination devices are not shown in this figure. Slide buttons 108, 110 are attached to stem supports 402, 406 and stem graspers 404, 408 which together form retractable securing attachments. The lollipop sticks 202, 302 are held by stem graspers 404, 408 respectively. Lollipop sticks 202, 304 can be secured to stem graspers 404, 408 by adhesive, pressure fit, threads on the inner wall of stem graspers 404, 408, etc. Stem supports 402, 406 provide a mechanical link between stem graspers 404, 408 and slide buttons 108, 110. If a user finishes a lollipop and wishes to insert a new one, then the retractable securing attachment is moved to the extended position, the old stem 202 or 302 is removed, and a new stem 202 or 302 is inserted into stem grasper 404 or 408.

In this figure, lollipops 204, 304 are shown in the retracted position with end caps 104, 106 attached. As can be seen, the lollipops 204, 304 are protected from exposure to contaminants in this position. Also seen in this figure is lamp switch 112 and lamp controller 410. The illumination circuitry will be discussed more fully below in regard to FIG. 4C.

Figure 4B:
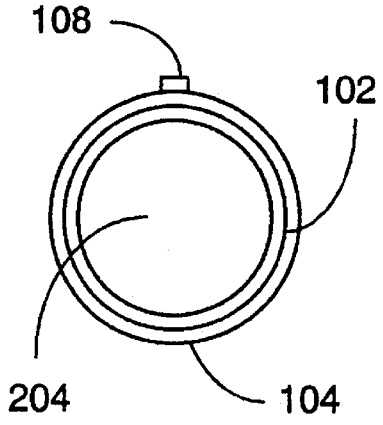
FIG. 4B is an end view of the embodiment of FIG. 4A.

FIG. 4B is an end view of the embodiment of FIG. 4A which shows the relative positions of end cap 104, central storage compartment 102 and lollipop 204.

Figure 4C:
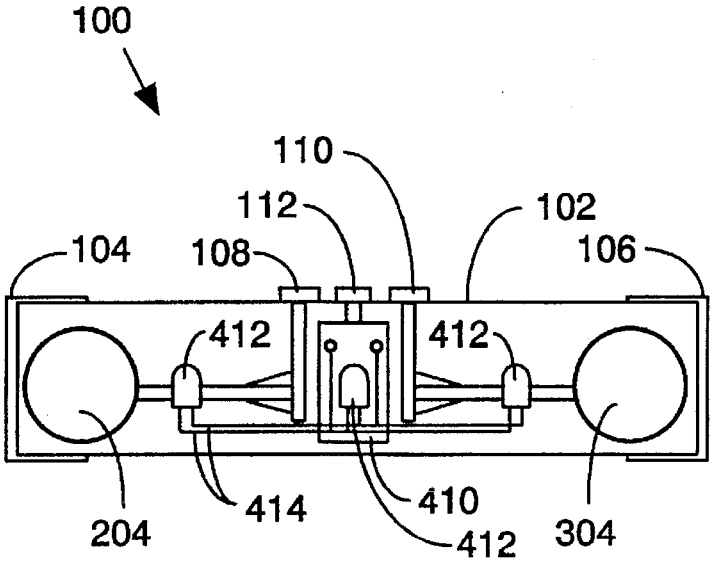
FIG. 4C is a cutaway side view of the embodiment of FIG. 4A illustrating interior lamps implemented by LEDs.

FIG. 4C is a side cutaway view of the embodiment of FIG. 4A which shows the illumination devices. In this embodiment, LEDs 412 are located such that they project light through light aperture 114. LEDs 412 are attached to lamp controller 410 via leads 414. Lamp controller 410 in this embodiment includes a battery power supply and circuitry that flashes LEDs 412 according to a predetermined pattern. Lamp switch 112 is used to activate or deactivate lamp controller 410. LED technology is well known in the art. Those skilled in the art will realize that if the lamp device permits, in its simplest for lamp controller 410 can be merely a power source with is controlled by lamp switch 112. Of course, more intelligent functions in a more complex lamp controller 410 allow more complex manipulation of illumination. For example, light can be varied in a particular frequency or pattern to entertain the user.

Figure 4D:
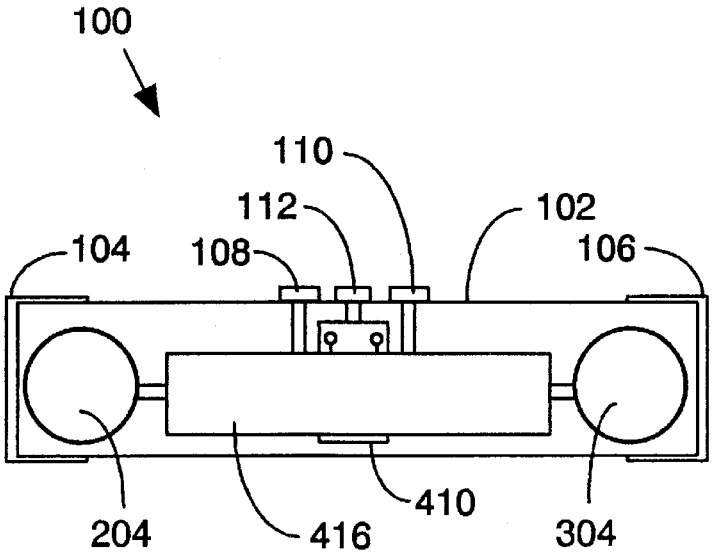
FIG. 4D is a cutaway side view of the embodiment of FIG. 4A illustrating interior lamps implemented by an EL panel.

FIG. 4D is a side cutaway view of an alternative embodiment which uses an EL lamp 416 as the illumination device. In this embodiment, EL lamp 416 is located such that it projects light through light aperture 114. EL lamp 416 is attached to lamp controller 410 via leads 414. Lamp controller 410 in this embodiment includes a battery power supply and circuitry that flashes EL lamp 416 according to a predetermined pattern. In addition lamp controller 410 includes a DC inverter to drive EL lamp 416.

Those skilled in the art will recognize that electroluminescent (EL) lamps 604 are well known in the art and commercially available from a variety of sources. For example, suitable EL lamps and matching DC inverters can be obtained from several manufacturers such as BKL, Inc. a corporation in King of Prussia, Pa., U.S.A.

EL lamps typically produce a specific color when illuminated by an AC signal. For portable usage, such as with a roller skate or skateboard, a battery makes a suitable power source for the DC inverter. Commercially available DC to AC inverters typically have an input voltage of 1.5 to 28 volts DC. Typical output ranges of DC inverters are 25 to 180 volts AC, and output frequencies range from 100 Hz to 5000 Hz.

Output of EL lamps are matched to a specific DC inverter to achieve maximum desired effect and maximum efficiency. Typically, DC inverters are selected based on the size of the EL lamp, brightness desired, and lamp-life considerations. The higher the output voltage and/or frequency of the DC inverter, the brighter the lamp.

EL lamps and DC inverters are well known in the art. But as a practical matter, the selection of the DC inverter, the type of battery, and the particular EL lamp chosen will be based on practical considerations such as the amount of surface area available to mount the EL lamp on, and the color and amount of brightness desired. Selection will also depend on the intended use, such as outdoors, where luminance may be more important for safety reasons, and indoor use where the color selected may have greater importance. Therefore, the selection of a particular size DC inverter and EL lamp surface area will typically be a design choice.

The following table illustrates a typical manufacturer's EL lamp performance based on applied voltage and frequency and their effect on luminance:

TABLE 1

| Type | Color | Volt. (VAC) | Freq. (Hz) | Lum. (Ft-L) | Lum. (Cd/M2 |
|---|---|---|---|---|---|
| Low Power Long Life | White | 40 | 2000 | 5.3 | 18.2 |
| Low Power Long Life | White | 90 | 650 | 25.0 | 85.7 |
| Low Power Long Life | White | 120 | 400 | 31.0 | 106.2 |
| Low Power Long Life | Aviation Green | 40 | 2000 | 8.5 | 29.1 |
| Low Power Long Life | Aviation Green | 90 | 650 | 32.0 | 109.6 |
| Low Power Long Life | Aviation Green | 120 | 60 | 8.0 | 27.4 |
| Low Power Long Life | Aviation Green | 120 | 400 | 36.0 | 123.3 |
| Low Power Long Life | Blue Green | 120 | 400 | 29.0 | 99.4 |
| Low Power Long Life | Yellow Green | 120 | 400 | 36.0 | 123.3 |
| High Power Short Life | White | 120 | 400 | 26.0 | 89.1 |
| High Power Short Life | Aviation Green | 40 | 2000 | 4.5 | 15.4 |
| High Power Short Life | Aviation Green | 120 | 400 | 28.0 | 95.9 |
| High Power Short Life | Blue Green | 120 | 400 | 28.0 | 95.9 |
| High Power Short Life | Green | 40 | 2000 | 6.0 | 20.6 |
| High Power Short Life | Green | 120 | 400 | 28.0 | 95.9 |

Figure 5A:
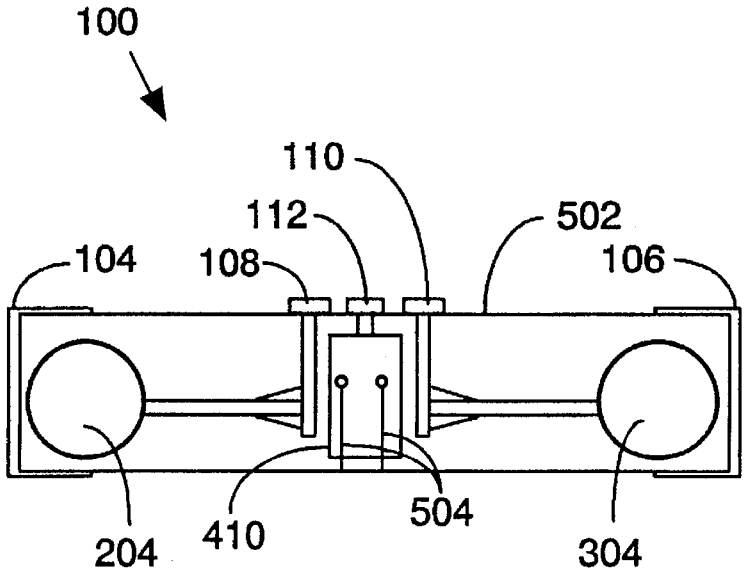
FIG. 5A is another alternative embodiment in which the lighting mechanism is an EL panel which is mounted on the outer surface of the lollipop holder.

FIG. 5A shows an alternative embodiment which uses an EL lamp 502 that covers the outer surface of the device. Leads 504 connect EL lamp 502 to lamp controller 410. EL lamp 502 can be cut to form specific patterns or it can cover substantially the entire outer surface of central storage compartment 102. Further, if the substrate used to form EL lamp 502 is sufficiently rigid, then central storage compartment 102 can be replaced by EL lamp 502.

Figure 5B:
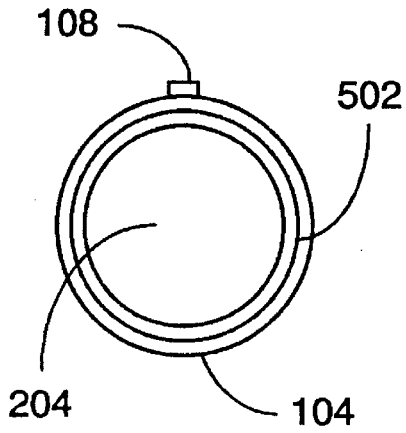
FIG. 5B is an end view of the embodiment of FIG. 5A.

FIG. 5B is an end view of the embodiment of FIG. 5A which shows the relative positions of end cap 104, EL lamp 502 and lollipop 204.

Those skilled in the art will recognize that there are many well known lighting technologies (for example, incandescent, neon, etc.). However, in a battery operated environment, technologies with lower power demands such as LED or EL lamps are preferred.

Figure 6:
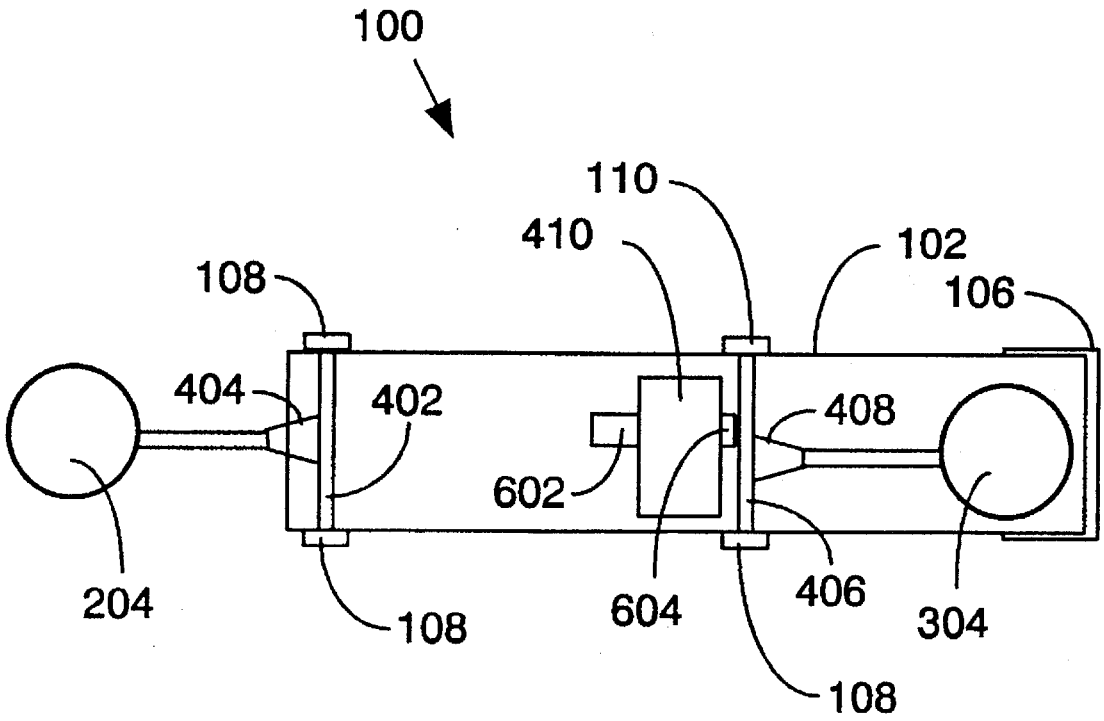
FIG. 6 is an alternative embodiment which uses internal lamp switches to automatically activate the lamps when a lollipop is extended.

FIG. 6 is an alternative embodiment which eliminates external (or manual) lamp switch 112 and replaces it with spring loaded internal (automatic) lamp switches 602, 604. When both lollipops 204, 304 are in the retracted position, lamp switches 602, 604 are automatically placed in the off position by stem supports 402, 406. In the off position, illumination of holder 100 is turned off. As shown in this figure, when lollipop 204 is advanced to the extended position, lamp switch 602 is released and is pushed to the on position by its internal spring. When in the on position, holder 100 is illuminated. As a result, whenever the user extends a lollipop for use, holder 100 is automatically illuminated. Automatic switching can be used with any lighting technology such as LED, EL lamps, etc. Further, spring loaded switches, such as those discussed above, are well known in the art.

Also shown in this figure is a configuration of stem graspers 404, 408 which completely enclose lollipop sticks 202, 302. Those skilled in the art will recognize that any configuration of stem grasper 404, 408 can be used so long as lollipop sticks 202, 302 are securely held.

Figure 7A:
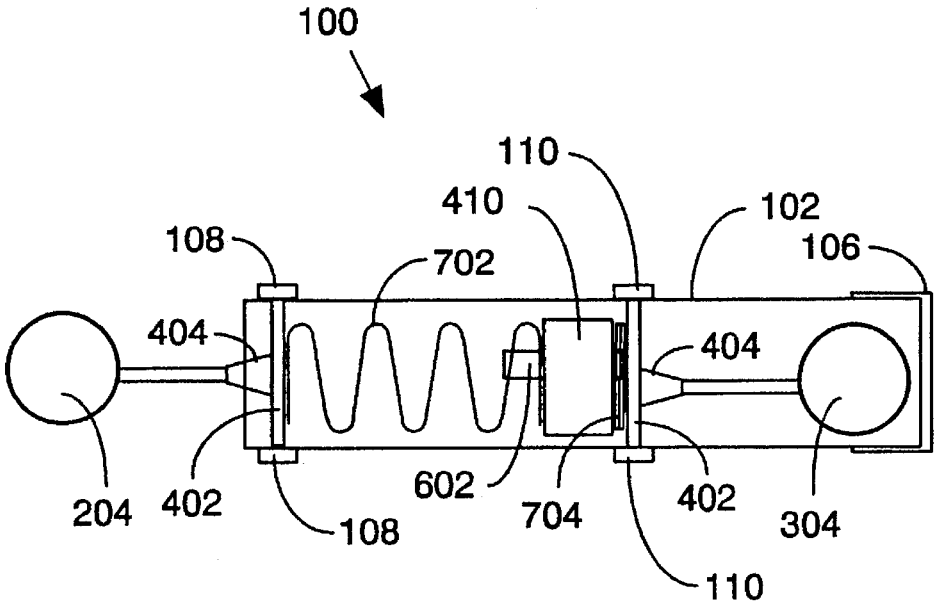
FIG. 7A is a cutaway view of a preferred embodiment of the device in which the retractable securing attachments are spring loaded.

FIG. 7A is an alternative embodiment which uses extension springs 702, 704 to automatically extend lollipops 204, 304 when slide buttons 108, 110 are activated. In this figure, lollipop 204 is shown in the extended position and lollipop 304 is shown in the retracted position. While in the retracted position extension spring 706 is compressed between lamp controller 410 and stem support 406 as shown. Extension spring 702 is shown in the extended position in which stem support 402 is pushed away from lamp controller 410. For ease of illustration, extension springs 702, 706 are shown resting against lamp controller 410. Those skilled in the art will recognize that extension springs 702, 706 can be secured against any part of the device and do not have to rest against lamp controller 410 which may in fact be located in a different area of holder 100 depending on a given design. It is only important that the end of extension springs 702, 706 are secured at their distal end (the distal end being farthest from lollipop 204, 304 and the proximal end being closest to lollipops 204, 304, respectively). The proximal ends are left free to exert pressure against stem supports 402, 406.

Also shown in this figure is an alternative method of attaching slide buttons 108, 110. In this embodiment, corresponding slide buttons 108, 110 are attached to the opposite side to improve mechanical stability.

Figure 7B:
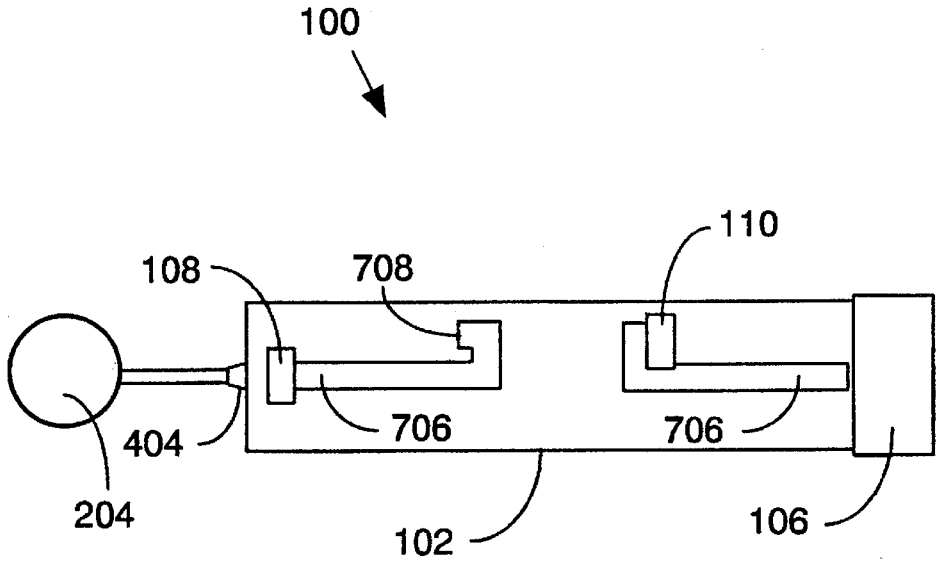
FIG. 7B is a side view of the device of FIG. 7A showing guide tracks for the retractable securing attachments.

FIG. 7B is a top view of holder 100. This embodiment illustrates a method of extending lollipops 204 from holder 100 by rotating slide button 108 from slot 708 such that it is free to travel along track 706 under pressure of spring 702. Those skilled in the art will recognize that any number of mechanisms can used to retain lollipops 204, 304 in the retracted position. Therefore, the structure shown herein should be considered illustrative only.

Those skilled in the art will recognize that the dual lollipop holder 100 can also be implemented as a single lollipop holder by eliminating the components required to hold the second pop. Of course, in the case of disposable holders 100, the cost of each individual lollipop becomes correspondingly more expensive. Likewise, lollipops of any size can be accommodated by constructing the storage compartment sufficiently large enough to accept the lollipop in question.

While the invention has been described with respect to a preferred embodiment thereof, it will be understood by those skilled in the art that various changes in detail my be made therein without departing from the spirit, scope, and teaching of the invention. For example, the material used to construct the device may be anything suitable for holding consumable confections, the size and shape of the holder shell can vary to suit any lollipop shape, the type of lighting and lighting control can vary, etc. Accordingly, the invention herein disclosed is to be limited only as specified in the following claims.

I claim:

1. A lollipop holder and storage device for use with lollipops, comprising:

a storage compartment having sufficient room to accept at least one lollipop;

at least one retractable securing assembly having means to securely grasp a lollipop stick; and means to move the retractable securing assembly to and from retracted and extended positions;

whereby a lollipop can be moved to an extended position for consumption and a retracted position for storage.

2. A device, as in claim 1, further comprising capping means to substantially seal the storage compartment when the retractable securing assembly is in the retracted position.

3. A device, as in claim 2, further comprising:

at least one lamp; and switch means to activate the lamp.

4. A device, as in claim 3, further comprising:

an aperture in the wall of the storage compartment to allow light to be emitted; and the lamp is an LED.

5. A device, as in claim 3, wherein the lamp is an EL lamp.

6. A device, as in claim 5, further comprising an aperture in the wall of the storage compartment to allow light to be emitted.

7. A device, as in claim 5, wherein the EL lamp is attached to the outer surface of the device such that when the EL lamp is activated, the device is illuminated.

8. A device, as in claim 1, further comprising:

spring means attached to the device such that it exerts pressure against the retractable securing assembly to move it to the extended position;

means to hold the spring means in a compressed state when the device is in the retracted position; and means to selectively release the spring means;

whereby the lollipop will automatically move to the extended position when the spring is released.

9. A device, as in claim 8, further comprising capping means to substantially seal the storage compartment when the retractable securing assembly is in the retracted position.

10. A device, as in claim 9, further comprising:

at least one lamp; and switch means to activate the lamp.

11. A device, as in claim 10, further comprising:

an aperture in the wall of the storage compartment to allow light to be emitted; and the lamp is an LED.

12. A device, as in claim 10, wherein the lamp is an EL lamp.

13. A device, as in claim 12, further comprising an aperture in the wall of the storage compartment to allow light to be emitted.

14. A device, as in claim 12, wherein the EL lamp is attached to the outer surface of the device such that when the EL lamp is activated, the device is illuminated.

15. A device, as in claim 1, further comprising:

at least one lamp; and switch means to activate the lamp.

16. A device, as in claim 15, wherein the lamp is an EL lamp.

17. A device, as in claim 16, wherein the EL lamp is attached to the outer surface of the device such that when the EL lamp is activated, the device is illuminated.

18. A device, as in claim 17, further comprising capping means to substantially seal the storage compartment when the retractable securing assembly is in the retracted position.

19. A device, as in claim 15, further comprising:

spring means attached to the device such that it exerts pressure against the retractable securing assembly to move it to the extended position;

means to hold the spring means in a compressed state when the device is in the retracted position; and means to selectively release the spring means;

whereby the lollipop will automatically move to the extended position when the spring is released.

20. A device, as in claim 19, further comprising capping means to substantially seal the storage compartment when the retractable securing assembly is in the retracted position.

* * * * *